US008772638B2

(12) United States Patent
Lumachi et al.

(10) Patent No.: US 8,772,638 B2
(45) Date of Patent: Jul. 8, 2014

(54) PROCESS FOR MANUFACTURING A CABLE RESISTANT TO EXTERNAL CHEMICAL AGENTS

(75) Inventors: Alberto Lumachi, Milan (IT); Paolo Veggetti, Milan (IT); Luca Giorgio De Rai, Milan (IT); Franck O'Neil, Lexington, SC (US); Alberto Bareggi, Milan (IT); Marco Frigerio, Milan (IT); Sergio Belli, Milan (IT)

(73) Assignee: Prysmian Cavi E Sistemi Energia S.R.L., Milan (IT)

( * ) Notice: Subject to any disclaimer, the term of this patent is extended or adjusted under 35 U.S.C. 154(b) by 699 days.

(21) Appl. No.: 12/542,259

(22) Filed: Aug. 17, 2009

(65) Prior Publication Data

US 2010/0000759 A1 Jan. 7, 2010

Related U.S. Application Data

(63) Continuation of application No. 11/587,968, filed as application No. PCT/US2004/011259 on Apr. 27, 2004, now Pat. No. 7,601,915.

(51) Int. Cl.
*H01B 7/18* (2006.01)

(52) U.S. Cl.
USPC ..... 174/107

(58) Field of Classification Search
USPC ..... 174/102 R, 107, 106 R, 120 SC
See application file for complete search history.

(56) References Cited

U.S. PATENT DOCUMENTS

| | | | | |
|---|---|---|---|---|
| 3,340,353 | A | 9/1967 | Mildner | |
| 4,104,210 | A | 8/1978 | Coran et al. | |
| 4,125,739 | A | 11/1978 | Bow | |
| 4,145,567 | A * | 3/1979 | Bahder et al. | 174/107 |
| 4,327,248 | A | 4/1982 | Campbell | |
| 4,472,595 | A | 9/1984 | Fox et al. | |
| 4,477,693 | A | 10/1984 | Krabec et al. | |
| 4,675,471 | A | 6/1987 | Shida et al. | |
| 4,868,054 | A | 9/1989 | Kartheiser | |

(Continued)

FOREIGN PATENT DOCUMENTS

| | | |
|---|---|---|
| EP | 0 324 430 B1 | 7/1989 |
| EP | 0 981 821 B1 | 3/2000 |

(Continued)

OTHER PUBLICATIONS

Derwent Abstract for JP S49-953.

(Continued)

*Primary Examiner* — Chau N Nguyen
(74) *Attorney, Agent, or Firm* — Finnegan, Henderson, Farabow, Garrett & Dunner, L.L.P.

(57) ABSTRACT

Process for manufacturing a cable comprising the following steps:(a) conveying at least one conductor to an extruder apparatus;(b) extruding an insulating coating layer radially external to said at least one conductor; (c) longitudinally folding a metal tape around said extruded insulating coating layer, said metal tape bearing at least one adhesive coating layer in a radially external position; (e) extruding at least one continuous coating layer comprising at least one polyamide or a copolymer thereof around and in contact with said folded metal tape; wherein the step (e) is carried out at a draw down ratio (DDR) not higher than 2.5, preferably of from 1.2 to 2.0.

22 Claims, 5 Drawing Sheets

(56) References Cited

U.S. PATENT DOCUMENTS

| | | | |
|---|---|---|---|
| 5,281,757 | A | 1/1994 | Marin et al. |
| 5,342,886 | A | 8/1994 | Glotin et al. |
| 6,246,006 | B1 | 6/2001 | Hardin et al. |
| 6,417,454 | B1 | 7/2002 | Biebuyck |
| 6,455,769 | B1 | 9/2002 | Belli et al. |
| 7,488,892 | B2 | 2/2009 | Belli et al. |

FOREIGN PATENT DOCUMENTS

| | | |
|---|---|---|
| JP | S49-953 | 1/1974 |
| JP | S57-157510 | 7/1982 |
| JP | S62-117202 | 5/1987 |
| JP | H8-106821 | 4/1996 |
| JP | 2005-531917 | 10/2005 |

OTHER PUBLICATIONS

Derwent Abstract for JP S62-117202.

Abstract for JP H8-106821.

Pirelli Energy Cables, "Drylam TM," Online, XP002312797, http://www.pirelli.com/en_42/cables_systems/energy/innovation/drydesign.jhtml, 1 sheet, (Jan. 7, 2005).

PCT International Search Report for PCT/US2004/011259.

* cited by examiner

PROCESS FOR MANUFACTURING A CABLE RESISTANT TO EXTERNAL CHEMICAL AGENTS

This is a continuation of application Ser. No. 11/587,968, filed Nov. 20, 2007, now U.S. Pat. No. 7,601,915 which was the national phase application of International Application No. PCT/US/04/011259, filed Apr. 27, 2004, all of which are incorporated herein by reference.

The present invention relates to a process for manufacturing a cable resistant to external chemical agents.

More particularly, the present invention relates to a process for manufacturing a cable, in particular an electrical cable for low-voltage, medium-voltage or high-voltage power transmission and/or distribution, which comprises at least one conductor, at least one metallic tape coated with at least one adhesive coating layer and at least one coating layer comprising at least one polyamide or a copolymer thereof.

Within the scope of the present invention, "low-voltage" generally means a voltage up to 1 kV, "medium-voltage" means a voltage between 1 kV and 35 kV, "high-voltage" means a voltage greater than 35 kV.

Electrical cables generally comprise one or more conductors individually coated with semiconductive and insulating polymeric materials and coated with protective coating layers which are also made of polymeric materials.

It is known that, in cables installed in critical environments such as, for example, oil refineries, oil pools, offshore installations, a major problem is given by the permeability of said polymeric cable coating layers to humidity and, in particular, to aggressive chemicals both of organic type such as, for example, hydrocarbons and solvents, and of inorganic type such as, for example, acids and bases. Penetration of said elements to the interior of the cables compromise their overall lifetime performance both in term of mechanical properties and electrical properties.

A conventional protection against said elements is generally achieved by applying a lead sheath. As a result, lead sheaths are commonly found over insulated wire conductors having, for example, paper/oil insulation, or solid dielectric such as ethylene-propylene rubber insulation, or crosslinked polyethylene insulation. Lead provides flexibility, hermetic sealing capability, and is considered relatively easy to extrude in long lengths. Cables of this type are commercially known, for example, as Solid Type PILC cables from The Okonite Company.

Welded corrugated aluminum (or copper) sheaths are also known to afford cable protection instead of lead sheaths. These aluminum sheaths are relatively light, provide hermetic sealing capability and may serve as a neutral conductor when placed over power cables. Cables of this type are commercially known, for example, as C-L-X® Type cables from The Okonite Company.

However, such sheaths still provide significant weight increase.

In order to avoid the use of both the lead sheaths and the corrugated aluminum sheaths above-mentioned, different solutions have already been proposed in the art.

U.S. Pat. No. 4,125,739 discloses a cable shielding tape comprising a metal strip having a first adhesive layer of polymeric resinous material tightly adhered to at least one side thereof and a bond control layer of polymeric resinous material strippably adhered to the first adhesive layer. Plastic jacketed electric power and communication cables utilizing such shielding tape are also disclosed. Materials which may be used to form the bond control layer include polypropylene, carboxyl modified polypropylene, polyamides, polyethylene therephthalate, fluoro polymers, 1,4-dimethylpentene polymers, ethylene/propylene copolymers, and stereoregular polystyrene. Materials which may be used to form the adhesive layer include polymers or copolymers of ethylene modified by monomers having reactive carboxylic acid groups. The outer plastic jackets of such cables is said to withstand delamination under conditions of normal use but can easily be removed to facilitate grounding and splicing procedures as the adhesive layer remains tightly adhered to the metal strip for protection against corrosion following the removal of the jacket.

U.S. Pat. No. 4,327,248 discloses tubing and electrical cable shields made of a flexible metal tape that has a coating of a copolymer of ethylene with a monomer having a reactive carboxyl group bonded to at least one of its sides and to which coating is bonded an adhesive that is adapted to bond the coating to flexible or semi-rigid non-olefinic polymeric materials. Flexible or semi-rigid non-olefinic polymeric materials which may be used are, for example, polyvinyl chloride or amorphic chlorinated polyethylene, or an elastomeric material such as polyurethane or synthetic rubbers. The adhesive may be selected from polyamide based adhesives.

U.S. Pat. No. 4,675,471 discloses an electrical cable comprising a conductive core and a metallic screen, wherein said metallic screen is coated with a coextruded film comprising a layer of a polymer selected for its properties of high flexural modulus, high tensile strength and high melting point and a layer of adhesive. The polymer layer is a polyamide, a copolyamide, or a copolyester. The adhesive is a copolymer of an olefin and at least one comonomer which is a polymerizable, ethylenically unsaturated carboxylic acid or acid anhydride or derivatives thereof or, alternatively, the adhesive comprises an adhesive blend of the copolymer and a polyolefin.

A cable comprising a sheating system including a longitudinally folded polyethylene coated aluminum tape (PE/AL/PE) is known and is commercialized by Pirelli under the trademark Drylam® sheathing system. During extrusion of the polyethylene jacket onto said aluminum tape, the polyethylene coating present at the overlapping region of said longitudinally folded aluminum tape seals together the overlapping edges providing excellent impermeability to moisture. In addition, the aluminum tape provides protection against electro magnetic interference. During the extrusion of the polyethylene jacket, the polyethylene coating present on the aluminum tape bonds the metallic shield to the polyethylene jacket giving the cable good mechanical properties. Moreover, the polyethylene jacket is highly resistant to inorganic chemicals such as acid and bases. A modified polyamide coating layer is applied with intimate adhesion to the polyethylene jacket. This material is highly resistant to organic chemicals such as hydrocarbons and solvents providing also termite proof and rodent resistant properties in case of non armoured cables.

Applicant has observed that the use of a sheath made of a laminated metal tape coated with an ethylene-based adhesive coating layer and a polyamide coating layer as disclosed, for example, in U.S. Pat. No. 4,675,471 above cited, is not as effective as desired in protecting the cable from the external attacks of both humidity and chemical agents. In particular, Applicant has observed that, when said laminated metal tape is longitudinally folded around an insulated conductor, in particular in the case the edges of said metal tape are overlapped, the risks of penetration of both humidity and chemical agents to the interior of the cable is very high due to the fact that the polyamide present at said overlapping edges does not allow an effective bonding of the overlapping edges. The penetration is due to both a poor bonding of the overlapping edges and a diffusion through the thickness of the adhesive and polyamide coating layers in the overlapping edges region. Moreover, said laminated metal tape has a remarkable thickness which cause an increase of both the cable weight and the cable outer diameter.

The use of the Drylam® sheathing system above disclosed allows to avoid the presence of the polyamide at the overlappings edges of the polyethylene coated aluminum tape thereby improving the bonding at the overlapping edges. However, the presence of a polyethylene coating layer around and in contact with the polyethylene coated aluminum tape is necessary in order to ensure a good adhesion between the coated aluminum tape and the polyamide layer thereby increasing the overall cable diameter.

Therefore, the Applicant has faced the problem of avoiding the use of said additional polyethylene coating layer. The elimination of said polyethylene coating layer would allow to further reduce the cable outer diameter and to manufacture a cable in a more economic way due to both a simplification in the manufacturing process and a cost reduction of the starting materials.

However, the Applicant has observed that, while it is possible to obtain a good adhesion between a metal tape coated with an ethylene-based adhesive coating layer and a polyamide coating layer by means of a calendering process, the same adhesion was not obtained by means of an extrusion process. In particular, the Applicant has observed that the extrusion of a polyamide coating layer onto a longitudinally folded metal tape coated with an ethylene-based adhesive coating layer did not allow an effective coupling between the coated metal tape and the polyamide coating layer.

The Applicant has now found that a cable with an effective seal against the penetration of both humidity and chemical agents can be obtained by folding an ethylene-based adhesive coated metal tape around the cable insulation, with overlapping edges, and extruding a polyamide coating layer directly around said folded aluminum tape. In particular, the Applicant has found that the coupling between the coated metal tape and the polyamide layer is greatly improved by carrying out the extrusion in certain conditions. More in particular, the Applicant has found that the extrusion of said polyamide coating layer has to be carried out controlling the draw down ratio (DDR).

Moreover, the Applicant has also found that, thanks to the use of said ethylene-based adhesive coated metal tape and said polyamide coating layer and to the effective protection against both humidity and chemical agents so obtained, it is possible to provide an effective mechanical protection to the cable by means of a protecting coating layer made of an expanded polymeric material. Said protecting coating layer made of an expanded polymeric material would be otherwise degraded by the penetration of both humidity and chemical agents. In this way, the metal armour usually applied to the cables commercially available in order to protect them from possible damages caused by accidental impacts, may be avoided.

In particular, the Applicant has found that by inserting into the structure of a cable, in a radially inner position with respect to the metal tape, a protecting coating layer made of an expanded polymeric material having adequate thickness and flexural modulus it is possible to obtain a cable having high impact strength, thereby making it possible to avoid the use of said protective metal armour. A cable with a protecting coating layer of this type has various advantages over a commercial cable with a protective metal armour such as, for example, easier manufacturing process, reduction in weight and dimensions of the finished cable and a reduced environmental impact as regards recycling of the cable once its working cycle is over.

In a first aspect the present invention therefore relates to a process for manufacturing a cable comprising the following steps:

(a) conveying at least one conductor to an extruder apparatus;
(b) extruding an insulating coating layer radially external to said at least one conductor;
(c) longitudinally folding a metal tape around said extruded insulating coating layer, said metal tape bearing at least one adhesive coating layer in a radially external position;
(d) extruding at least one continuous coating layer comprising at least one polyamide or a copolymer thereof around and in contact with said folded metal tape;

wherein the step (d) is carried out at a draw down ratio (DDR) not higher than 2.5, preferably of from 1.2 to 2.0.

Preferably said step (d) is carried out at a temperature of between 220° C. and 300° C., more preferably of between 230° C. and 270° C.

Preferably, said step (c) of folding the metal tape comprises the step of overlapping the edges of said metal tape. In this case, preferably, said step (c) of folding the metal tape comprises the additional step of bonding the overlapping edges of said metal tape.

Preferably, said metal tape bears at least one further adhesive coating layer in a radially internal position.

Preferably, said process comprises a further step of applying at least one coating layer made of an expanded polymeric material in a radially inner position with respect to said metal tape. Preferably, said coating layer is applied by extrusion.

In the present description and in the subsequent claims, the term "draw down ratio" (DDR) means the ratio between the cross-sectional area defined between two adjacent dies of the extruder apparatus and defining the section for the passage of the coating material, said area being calculated at the outlet section of the extrusion head, and the cross-sectional area of the effective deposited coating material.

In a second aspect, the present invention relates to a cable comprising:

at least one conductor;
at least one insulating coating layer around said at least one conductor;
at least one metal tape longitudinally folded around said at least one insulated conductor, said metal tape bearing on its externally facing surface at least one adhesive coating layer;
at least one continuous coating layer comprising at least one polyamide or a copolymer thereof in a radially external position with respect to said at least one adhesive coating layer, said continuous coating layer being in contact with said at least one adhesive coating layer.

Preferably, said longitudinally folded metal tape has overlapping edges.

Preferably, said metal tape has a thickness of from 0.05 mm to 1.0 mm, more preferably from 0.1 mm to 0.5 mm.

Preferably, said adhesive coating layer has a thickness of from 0.01 mm to 0.1 mm, more preferably from 0.02 mm to 0.08 mm.

Preferably, said continuous coating layer has a thickness of from 0.5 mm to 3.0 mm, more preferably from 0.8 mm to 2.5 mm.

According to one preferred embodiment, said cable comprises at least one further adhesive coating layer in a radially inner position with respect to said at least one metal tape, said at least one adhesive-coating layer being in contact with said at least one metal tape.

According to a further preferred embodiment, said cable further comprises, in a radially inner position with respect to said at least one metal tape, at least one coating layer made of an expanded polymeric material.

In the present description and in the subsequent claims, the term "conductor" means a conductive element as such, of elongated shape, of circular or sectorial configuration, formed as a solid rod or as a strand of plurality of wires, preferably made of a metal material. Where convenient, said conductive element is coated with at least one semiconductive coating layer such as, for example, in the case of electrical cables for medium-voltage or high-voltage power transmission and/or distribution.

In the present description and in the subsequent claims, the term "continuous coating layer" is understood as meaning a uniform and substantially uninterrupted coating layer, both in the axial direction and in the circumferential direction, extending over to the length of the cable. This means that the continuous coating layer does not show any longitudinal or helical overlapping or adjoining portions.

According to one preferred embodiment, said conductor is made of copper or aluminum.

According to one preferred embodiment, said insulating coating layer may comprise at least one crosslinked ethylene/propylene (EPR) or ethylene/propylene/diene (EPDM) elastomeric copolymers, preferably from crosslinked ethylene/propylene (EPR) copolymers.

Alternatively, said insulating coating layer may comprise at least one crosslinked or non-crosslinked polyolefin-based polymeric material. Preferably, the polyolefin-based polymeric is selected from: polyolefins, copolymers of different olefins, copolymers of an olefin with an ethylenically unsaturated ester, polyesters, polyacetates, cellulose polymers, polycarbonates, polysulphones, phenol resins, urea resins, polyketones, polyacrylates, polyamides, polyamines, or mixtures thereof. Examples of suitable polymers are: polyethylene (PE), in particular low density PE (LDPE), medium density PE (MDPE), high density PE (HDPE), linear low density PE (LLDPE), ultra-low density polyethylene (ULDPE); polypropylene (PP); ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof; or mixtures thereof.

In making the insulating coating layer for the cable according to the present invention, other conventional components may be added to the above disclosed insulating materials, such as antioxidants, processing aids, water tree retardants, or mixtures thereof.

Conventional antioxidants suitable for the purpose are, for example, distearyl- or dilauryl-thiopropionate and pentaerythrityl-tetrakis [3-(3,5-di-t-butyl-4-hydroxyphenyl)propionate], or mixtures thereof.

Processing aids which may be added to the insulating material include, for example, calcium stearate, zinc stearate, stearic acid, or mixtures thereof.

According to one preferred embodiment, said metal tape may be made of aluminum, aluminum alloys, alloy-clad aluminum, copper, bronze, steel, tin free steel, tin plate steel, aluminized steel, stainless steel, copper-clad stainless steel, terneplate steel, galvanized steel, chrome or chrome-treated steel, lead, magnesium, tin, or mixtures thereof. Aluminum is preferred.

According to one preferred embodiment, the adhesive coating layer may comprise at least one copolymer of ethylene or propylene with at least one comonomer selected from ethylenically unsaturated carboxylic acids.

Preferably, said copolymer of ethylene or propylene with at least one comonomer selected from ethylenically unsaturated carboxylic acids may be selected, for example, from copolymers having a major portion of ethylene or propylene and a minor portion, preferably from 1% by weight to 30% by weight, more preferably from 2% by weight to 20% by weight, with respect to the total copolymer weight, of an ethylenically unsaturated carboxylic acid.

Specific examples of ethylenically unsaturated carboxylic acids, which term includes mono- and poly-basic acids, acid anhydrides, and partial esters of polybasic acids, which may be advantageously used for the aim of the present invention, are: acrylic acid, methacrylic acid, crotonic acid, fumaric acid, maleic acid, itaconic acid, maleic anhydride, monomethyl maleate, monoethyl maleate, monomethyl fumarate, monoethyl fumarate, tripropylene glycol monomethyl ether acid maleate, ethylene glycol monophenyl ether acid maleate, or mixture thereof. Preferably, the carboxylic acid comonomer may be selected, for example, from α,β-ethylenically unsaturated mono- and poly-carboxylic acids and acid anhydrides having from 3 to 8 carbon atoms per molecule and partial esters of such polycarboxylic acids wherein the acid moiety has at least one carboxylic acid group and the alcohol moiety has from 1 to 20 carbon atoms.

Preferably, said copolymer may consist essentially of ethylene or propylene and one or more ethylenically unsaturated acid comonomers above reported or may also contain small amount of different comonomers copolymerizable with ethylene. Thus, the copolymer may contain other copolymerizable comonomers including an ester of acrylic acid. More preferably, said copolymer is a copolymer of ethylene with acrylic or methacrylic acid or with acrylic or methacrylic ester.

Said copolymer may be selected from block, random or graft copolymers. Copolymers of these type may be prepared according to processes known in the art. For example, said copolymers may be prepared by subjecting a mixture of the starting monomers to elevated temperatures, usually from about 90° C. to about 300° C., preferably from 120° C. to about 280° C., and at higher pressure, usually above 1,000 atm, preferably from 1,000 atm to 3,000 atm, preferably in the presence of a free-radical initiator such as oxygen, a peroxygen, compound or an azo compound.

Examples of copolymer of ethylene with at least one comonomer selected from ethylenically unsaturated carboxylic acids which may be used according to the present invention and which are available commercially are the products known by the name of Lucalen® from Basell.

According to one preferred embodiment, the polyamide or a copolymer thereof may be selected, for example, from the condensation products of at least one amino acid such as, for example, aminocaproic acid, 7-aminoheptanoic acid, 11-aminoundecanoic acid, 12-aminododecanoic acid, or of at least one lactam, such as, for example, caprolactam, oenantholactam, lauryllactam, or of at least one salt or mixtures of diamines such as, for example, hexamethylenediamine, dodecamethylene diamine, metaxylylenediamine, bis(p-aminocyclohexyl)methane, trimethylhexamethylene, with at least one diacid such as, for example, isophthalic acid, terephthalic acid, azelaic acid, suberic acid, sebacic acid, dodecanedicarboxylic acid; or mixtures of all these monomers which lead to copolyamides.

Specific example of polyamide or a copolymer thereof which may be advantageously used according to the present invention are: nylon 6, nylon 6/12, nylon 11, nylon 12, or mixtures thereof.

According to one preferred embodiment, said polyamide or a copolymer thereof are used in blend with at least one polyolefin.

The term "polyolefin" should be understood as meaning a polymer comprising olefin units such as, for example, ethylene, propylene, 1-butene, or their higher homologues.

Specific examples of polyolefins which may be advantageously used according to the present invention are:

- polyethylene, polypropylene, copolymers of ethylene with α-olefins, said products being optionally grafted with unsaturated carboxylic acid anhydrides such as, for example, maleic anhydride, or by unsaturated epoxides such as, for example, glycidyl methacrylate, or mixtures thereof;
- copolymers of ethylene with at least one product selected from: (i) unsaturated carboxylic acids, their salts or their esters; (ii) vinyl esters of saturated carboxylic acids; (iii) unsaturated dicarboxylic acids, their salts, their esters, their half-esters, or their anhydrides; (iv) unsaturated epoxides; said ethylene copolymers being optionally grafted with unsaturated dicarboxylic acid anhydrides or unsaturated epoxides;
- styrene/ethylene-butylene/styrene block copolymers (SEBS), optionally maleinized;

or blends thereof.

Preferebly, the following polyolefins may be advantageously used:

- polyethylene;
- copolymers of ethylene with α-olefins;
- ethylene/alkyl(metha)acrylate copolymers;
- ethylene/alkyl(meth)acrylate/maleic anhydride copolymers, the maleic anhydride being grafted or copolymerized;
- ethylene/alkyl(meth)acrylate/glycidyl(meth)-acrylate copolymers, the glycidyl(meth)acrylate being grafted or copolymerized;
- polypropylene.

In order to improve the formation of the polyamide/polyolefin blend, in particular in the case wherein the polyolefin has few or no functional groups able to facilitate its compatibilization with the polyamide, a compatibilizer may be preferably added.

Specific examples of compatibilizers which may be advantageously used according to the present invention are:

- polyethylene, polypropylene, ethylene-propylene copolymers, ethylene-butylene copolymers, all these products being grafted by maleic anhydride or glycidyl methacrylate;
- ethylene/alkyl(meth)acrylate/maleic anhydride copolymers, the maleic anhydride being grafted or copolymerized;
- ethylene/vinyl acetate/maleic anhydride copolymers, the maleic anhydride being grafted or copolymerized;
- the above two copolymers in which the maleic anhydride is replaced with glycidyl(meth)acrylate;
- ethylene/(meth)acrylic acid copolymers and their salts;
- polyethylene, polypropylene or ethylene-propylene copolymers, these polymers being grafted with a product having a site which reacts with amines, these grafted copolymers then being condensed with polyamides or polyamide oligomers having a single-amine end group.

Preferably, the polyamide/polyolefin blend comprises:

from 55 parts by weight to 95 parts by weight of polyamide;

from 5 parts by weight to 45 parts by weight of polyolefin.

The compatibilizer may be present in an amount which is sufficient for the polyolefin to be dispersed in the form of nodules in the polyamide. Preferably, the compatibilizer represent up to 20% by weight of the polyolefin.

The polyamide/polyolefin blend may be obtained by blending the polyamide, the polyolefin, and the compatibilizer optionally present, by means of a standard melt-blending technique. The melt-blending may be carried out, for example, by means of twin-screw extruder, Buss, single-screw-extruder.

More detailed informations about the above-mentioned polyamide/polyolefin blends may be found, for example, in U.S. Pat. No. 5,342,886.

Examples of polyamide/polyolefin blends which may be used according to the present invention and are available commercially are the products known by the name of Orgalloy® from Atofina.

As already disclosed above, the cable according to the present invention, may comprises at least one coating layer made of an expanded polymeric material.

The expanded polymeric material may comprise at least one expandable polymer which may be selected, for example, from: polyolefins, copolymers of different olefins, copolymers of an olefin with an ethylenically unsaturated ester, polyesters, polycarbonates, polysulphones, phenol resins, urea resins, or mixtures thereof. Examples of suitable polymers are: polyethylene (PE), in particular low density PE (LDPE), medium density PE (MDPE), high density PE (HDPE), linear low density PE (LLDPE), ultra-low density-polyethylene (ULDPE); polypropylene (PP); elastomeric ethylene/propylene copolymers (EPR) or ethylene/propylene/diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA) and ethylene/butyl acrylate (EBA); ethylene/α-olefin thermoplastic copolymers; polystyrene; acrylonitrile/butadiene/styrene (ABS) resins; halogenated polymers, in particular polyvinyl chloride (PVC); polyurethane (PUR); polyamides; aromatic polyesters such as polyethylene terephthalate (PET) or polybutylene terephthalate (PBT); and copolymers thereof; or mixtures thereof.

Preferably, said expandable polymer may be selected from polyolefin polymers or copolymers based on ethylene and/or propylene. More preferably, said expandable polymer may be selected from:

(i) copolymers of ethylene with an ethylenically unsaturated ester, for example vinyl acetate or butyl acetate, in which the amount of unsaturated ester is generally between 5% by weight and 80% by weight, preferably between 10% by weight and 50% by weight;

(ii) elastomeric copolymers of ethylene with at least one $C_3$-$C_{12}$ α-olefin, and optionally a diene, preferably ethylene/propylene (EPR) or ethylene/propylene/diene (EPDM) copolymers, generally having the following composition: 35%-90% mole of ethylene, 10%-65% mole of α-olefin, 0%-10% mole of diene (for example 1,4-hexadiene or 5-ethylidene-2-norbornene);

(iii) copolymers of ethylene with at least one $C_4$-$C_{12}$ α-olefin, preferably 1-hexene or 1-octene, and optionally a diene, generally having a density of between 0.86 g/cm$^3$ and 0.90 g/cm$^3$ and the following composition: 75%-97% by mole of ethylene; 3%-25% by mole of α-olefin; 0%-5% by mole of a diene;

(iv) polypropylene modified with ethylene/$C_3$-$C_{12}$ α-olefin copolymers, wherein the weight ratio between polypropylene and ethylene/$C_3$-$C_{12}$ α-olefin copolymer is comprised between 90/10 and 10/90, preferably between 80/20 and 20/80.

For example, the commercial products Elvax® (DuPont), Levapren® (Bayer) and Lotryl® (Elf-Atochem) are in class (i), products Dutral® (Enichem) or Nordel® (Dow-DuPont) are in class (ii), products belonging to class (iii) are Engage® (Dow-DuPont) or Exact® (Exxon), while polypropylene modified with ethylene/α-olefin copolymers (iv) are commercially available under the brand names Moplen® or Hifax® (Basell), or also Fina-Pro® (Fina).

Within class (iv), particularly preferred are thermoplastic elastomers comprising a continuous matrix of a thermoplastic polymer, e.g. polypropylene, and fine particles (generally having a diameter of the order of 1 μm-10 μm) of a cured elastomeric polymer, e.g. crosslinked EPR ○ EPDM, dispersed in the thermoplastic matrix. The elastomeric polymer may be incorporated in the thermoplastic matrix in the uncured state and then dinamically crosslinked during processing by addition of a suitable amount of a crosslinking agent. Alternatively, the elastomeric polymer may be cured separately and then dispersed into the thermoplastic matrix in the form of fine particles. Thermoplastic elastomers of this type are described, for example, in U.S. Pat. No. 4,104,210, or in European Patent Application EP 324,430. These thermoplastic elastomers are preferred since they proved to be particularly effective in elastically absorb radial forces during the cable thermal cycles in the whole range of working temperatures.

For the purposes of the present description, the term "expanded" polymer is understood to refer to a polymer within the structure of which the percentage of "void" volume (that is to say the space not occupied by the polymer but by a gas or air) is typically greater than 10% of the total volume of said polymer.

In general, the percentage of free space in an expanded polymer is expressed in terms of the degree of expansion (G). In the present description, the term "degree of expansion of the polymer" is understood to refer to the expansion of the polymer determined in the following way:

$$G(\text{degree of expansion})=(d_0/d_e-1)\times 100$$

where $d_0$ indicates the density of the non-expanded polymer (that is to say the polymer with a structure which is essentially free of void volume) and $d_e$ indicates the apparent density measured for the expanded polymer.

Preferably, the degree of expansion of said expanded polymer coating layer may be selected in the range of from 20% to 200%, more preferably from 25% to 130%.

More details about to the above reported expanded polymeric material may be found, for example, in European Patent EP 981,821.

As already mentioned above, the conductor may comprises a conductive element coated with a semiconductive coating layer; conveniently, a further semiconductive coating layer may be present outside the insulating coating layer.

Cable coating layers with semiconductive properties may be produced in accordance with the known art and comprises, advantageously, a semiconductive polymeric material. Preferably, said polymeric material is of the same type as that used for the coating layer with electrical insulation properties, so as to ensure good adhesion and hence avoid detachments that would generate partial discharges and, ultimately, perforation of the cable.

In the case when it is intended to make a semiconductive layer, in general a conducting filler is dispersed in the polymeric material, in particular carbon black, in a quantity such as to endow said material with semiconductive characteristics (i.e. so as to obtain a resistivity of less than 5 Ω·m at room temperature). Said quantity is generally between 5% and 80% by weight, preferably between 10% and 50% by weight, with respect to the total weight of the final composition.

In addition, a cable according to the present invention may comprise a screen, said screen consisting of electrically conducting wires or tapes wound spirally, arranged around the semiconductive coating layer positioned outside the insulating coating layer.

Furthermore, in addition to the coating layers defined above, the cable according to the present invention may comprise at least one coating layer with the function of external protective sheath (hereinafter referred to as "outer sheath"), usually comprising a thermoplastic material such as, for example, flexible polyvinylchloride (PVC), uncrosslinked polyethylene, in particular, medium density polyethylene (MDPE), or uncrosslinked homopolymer or copolymer of propylene. Alternatively, said outer sheath may have self-extinguishing properties and may be made of a flame-retardant composition comprising:

at least one polymer selected, for example, from: polyolefins, various olefin copolymers, copolymers of olefins with ethylenically unsaturated esters, polyesters, polyethers, polyether/polyester copolymers, or mixtures thereof;

at least one inorganic filler selected, for example, from: hydroxides, hydrated oxides, salts or hydrated salts of metals, in particular of calcium, aluminium or magnesium, such as: magnesium hydroxide, alumina trihydrate, hydrated magnesium carbonate, magnesium carbonate, hydrated calcium and magnesium carbonate, calcium and magnesium-carbonate, or mixtures thereof; and, optionally, at least one coupling agent selected, for example, from: silane compounds containing at least one ethylenic unsaturation; epoxides containing an ethylenic unsaturation; monocarboxylic acids or, preferably, dicarboxylic acids having at least one ethylenic unsaturation, or derivatives thereof, in particular anhydrides or esters, or mixtures thereof.

More details about the above reported flame-retardant composition may be found, for example, in U.S. Pat. Nos. 6,162,548 and 6,495,760, in European patents EP 998,747, 893,802, 1,116,244 and in International Patent Application WO 00/39810.

Further details will be illustrated in the following, appended drawings, in which.

Figure 1:
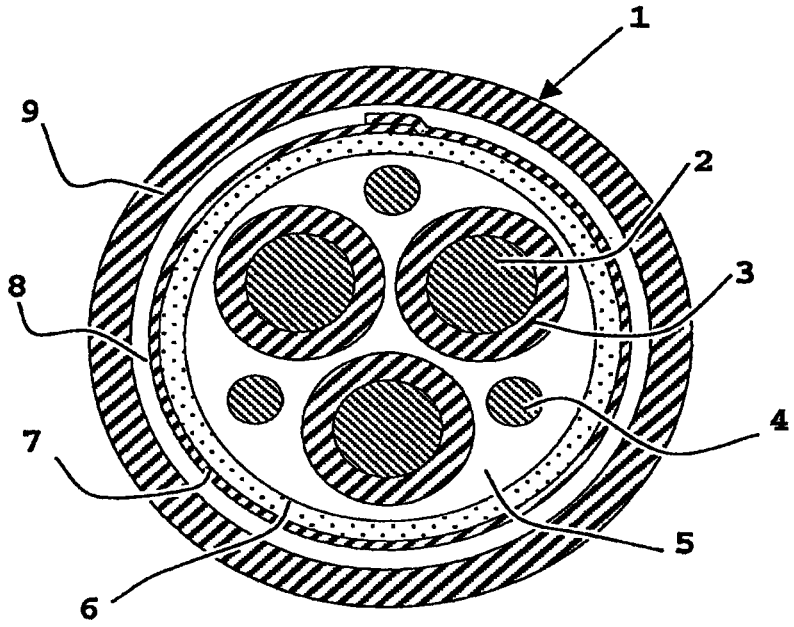
FIG. 1 shows, in cross section, an example of a low-voltage electric cable of the tripolar type according to one embodiment of the present invention.

Referring to FIG. 1, a low-voltage cable of the tripolar type 1 comprises three conductors 2, each one covered by an insulating coating layer 3 made, for example, of crosslinked ethylene/propylene rubber, or of a crosslinked or non-crosslinked polyolefin-based polymeric material which may be selected from those disclosed above. The insulated conductors 2 and the three bare copper earth wires 4 are stranded together and the interstices between the insulated conductors 2 are filled with a filler material 5 that forms a continuous structure having a substantially cylindrical shape. The filler material 5 is generally made of elastomeric mixtures or polypropylene fibres, more preferably is made of a flame-retarding material. Furthermore, cable 1 comprises, in order from the interior to the exterior: a coating layer 6 made of an expanded polymeric material which may be selected from those disclosed above, a metal tape coated with an adhesive layer 7, preferably an aluminum tape coated with an adhesive layer comprising an ethylene/acrylate copolymer, a continuous coating layer 8 comprising at least one polyamide or a copolymer thereof, preferably a polyamide/polyolefin blend, an outer sheath 9 made of a thermoplastic material, preferably medium density polyethylene or polyvinyl chloride, or of a flame-retardant composition which may be selected from those disclosed above.

Figure 2:
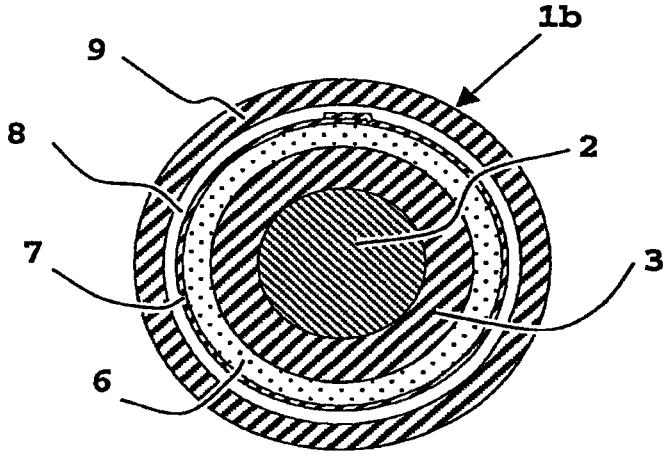
FIG. 2 shows, in cross section, an example of a low-voltage electric cable of the unipolar type according to a further embodiment of the present invention.

Referring to FIG. 2, a low-voltage cable of the unipolar type 1*b* comprises a metallic conductor 2, an insulating coating layer 3 made, for example, of crosslinked ethylene/propylene rubber, or of a crosslinked or non-crosslinked polyolefin-based polymeric material which may be selected from those disclosed above, a coating layer 6 made of an expanded polymeric material which may be selected from those disclosed above, a metal tape coated with an adhesive layer 7, preferably an aluminum tape coated with an adhesive layer comprising an ethylene/acrylate copolymer, a continuous coating layer 8 comprising at least one polyamide or a copolymer thereof, preferably a polyamide/polyolefin blend, an outer sheath 9 made of a thermoplastic material, preferably of medium density polyethylene or of a flame-retardant composition which may be selected from those disclosed above.

Figure 3:
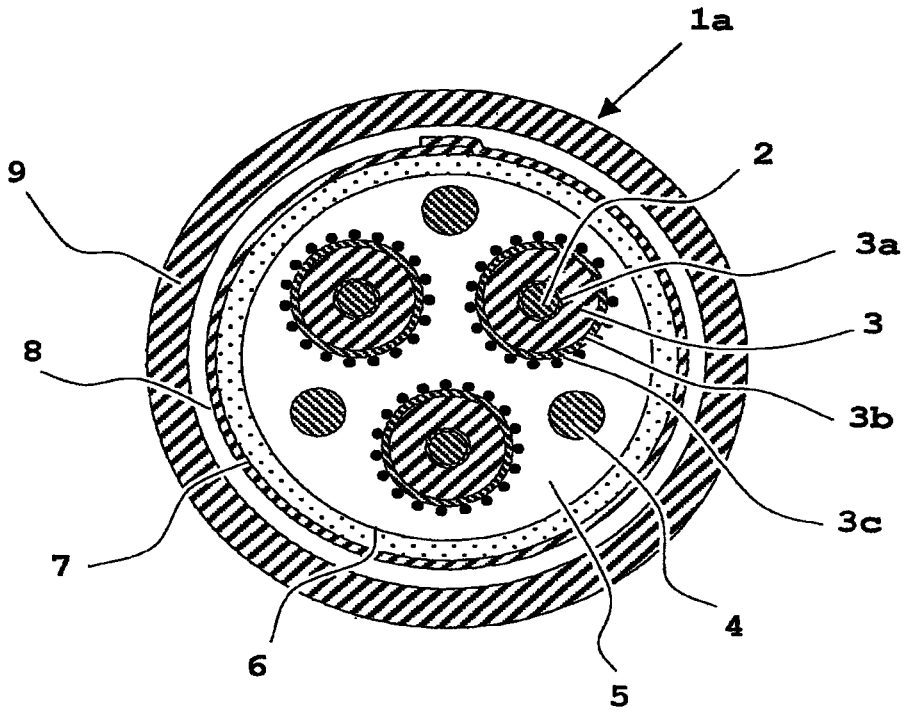
FIG. 3 shows, in cross section, an example of a medium-voltage electric cable of the tripolar type according to a further embodiment of the present invention.

Referring to FIG. 3, a medium-voltage cable of the tripolar type 1*a* comprises the same elements of cable 1 of FIG. 1 which are indicated with the same reference numbers of FIG. 1, with the difference that around the conductor 2 are present, from the interior to the exterior: an internal semiconductive coating layer 3*a*, an insulating coating layer 3, an external semiconductive coating layer 3*b*, a screen 3*c*, generally consisting of spirally wound electrically conducting wires or tapes, arranged around the external semiconductive coating layer 3*b*.

Figure 4:
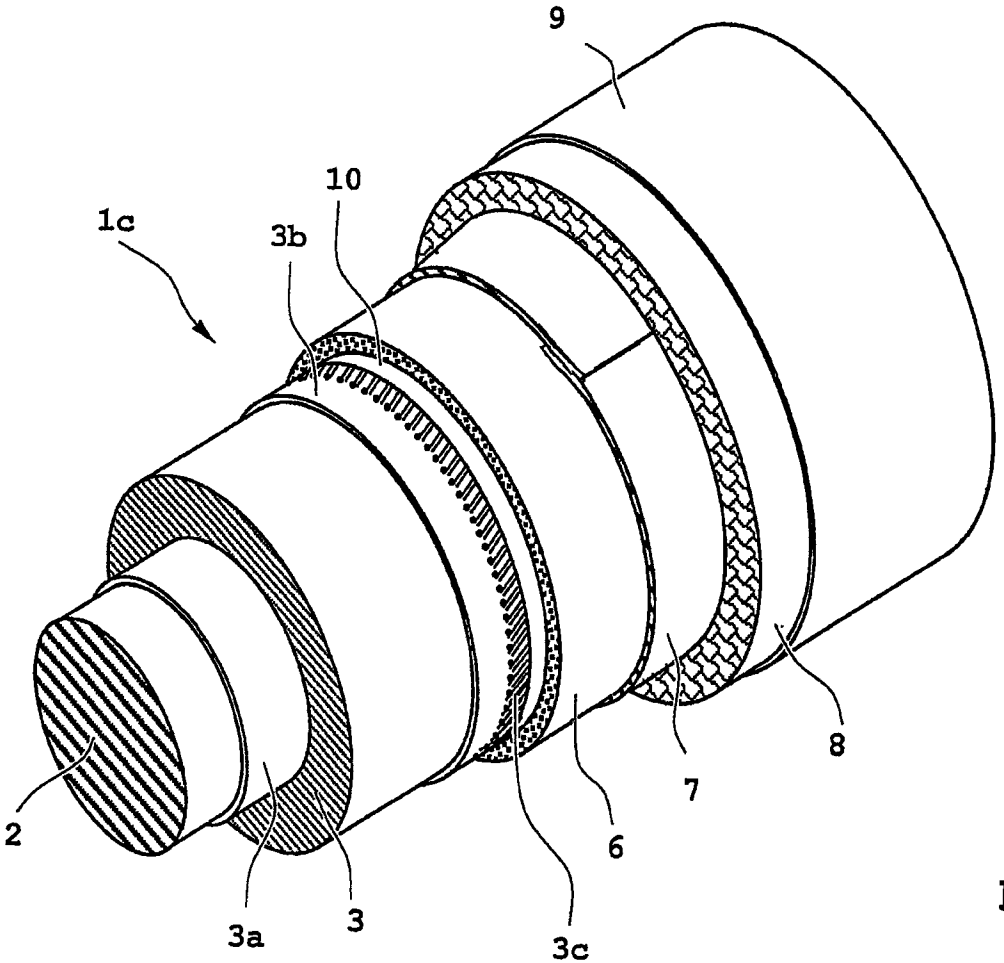
FIG. 4 shows, in perspective view, a length of a medium-voltage cable of the unipolar type with parts removed in stages, to reveal its structure.

Referring to FIG. 4, a medium-voltage cable of the unipolar type 1*c* comprises, in order from the centre outwards: a conductor 2, an internal semiconductive coating layer 3*a*, an insulating coating layer 3 made, for example, of crosslinked ethylene/propylene rubber, or of a crosslinked or non-crosslinked polyolefin-based polymeric material selected from those disclosed above, an external semiconductive coating layer 3*b*, a screen 3*c*, generally consisting of electrically conducting wires or tapes wound spirally, arranged around the external semiconductive coating layer 3*b*, a tape 10 preferably made of polyesters, a coating layer made of an expanded polymeric material 6 which may be selected from those disclosed above, a metallic tape coated with an adhesive layer 7, preferably an aluminum tape coated with an adhesive layer comprising an ethylene/acrylate copolymer, a continuous coating layer 8 comprising at least one polyamide or a copolymer thereof, preferably a polyamide/polyolefin blend, an outer sheath 9 made of a thermoplastic material, preferably medium density polyethylene or polyvinyl chloride, or of a flame-retardant composition which may be selected from those disclosed above.

The internal and external semiconductive coating layers 3*a*, 3*b* of FIG. 3 and FIG. 4 may be made as reported above, preferably from a composition comprising a polymeric material of the same type as that used for the insulating coating layer and carbon black.

Figure 5:
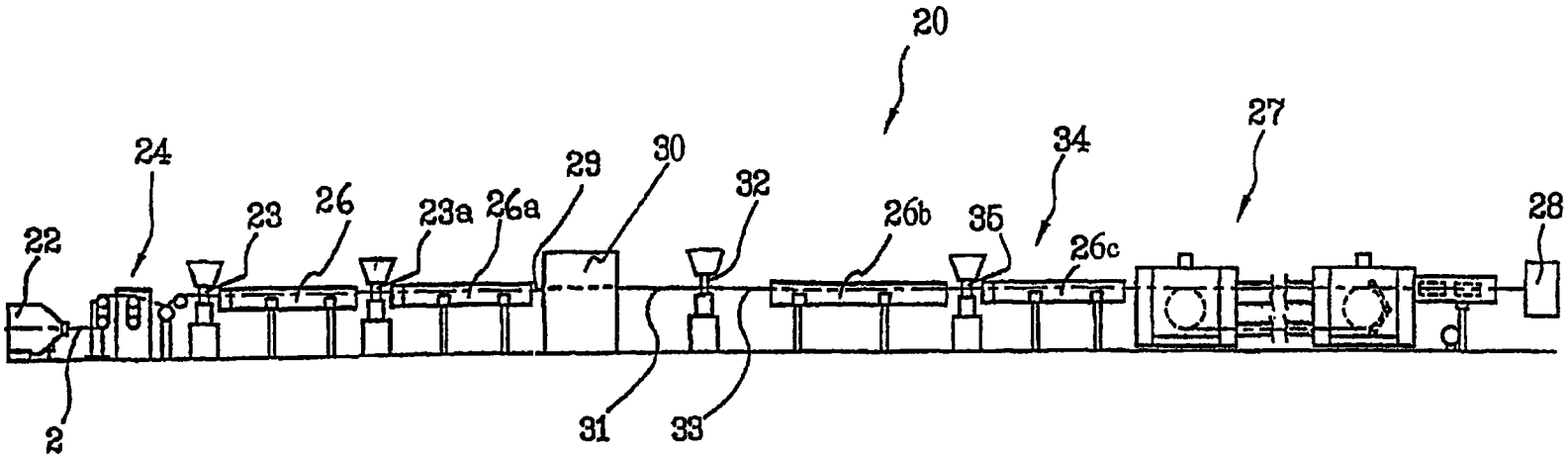
FIG. 5 shows a side view of a production line suitable to practice the process of the present invention.

Referring to FIG. 5, a production line for manufacturing a cable according to the present invention is shown in a schematic form.

The mains steps characterizing the aforesaid process are described herein below with reference to the case in which it is required to make a cable of the unipolar type (e.g. as in the enclosed FIG. 2 or FIG. 4).

More specifically, FIG. 5 represents a schematic view of a processing line 20.

An electrical conductor 2 is unwound from a feed reel 22 according to any known technique, and conveyed towards the extrusion head of an extruder apparatus 23, by which an insulating coating layer 3 is extruded over the conductor 2, for example an extruder apparatus of the screw type.

Conveniently, the conductor 2 is fed through a feeding system 24 which provide a controlled fed speed of the conductor, as required to ensure a regular extrusion of the insulating coating layer 3.

Typically, the forward speed of the conductor 2 is between 0.2 m/min and 1500 m/min, depending on the insulating coating layer thickness, on the conductor diameter, on the type of cable to be produced, and so on. For example, for a low-voltage cable, the forward speed of the conductor is typically between 15 m/min and 1500 m/min while, for a medium-voltage cable, it is typically between 2 m/min and 30 m/min.

The extruder apparatus 23 is suitable to extrude the insulating coating layer 3 (in the case in which the semicondutive coating layers are present, two further extruder apparatus may be present, which may be arranged in succession, each with its own extrusion head or, preferably, they are all connected to a common triple extrusion head to obtain the coextrusion of said three layers).

The extruded insulating coating layer 3 is subjected to a cooling step which is carried out in a cooling section 26 which may consist of an elongated open duct or channel along which a cooling fluid is caused to flow. Water is a preferred example of such a cooling fluid. The length of such cooling section, as well as the nature, temperature and flow rate of the cooling fluid, are determined to provide a final temperature suitable for the subsequent steps of the process.

A drier (not represented in FIG. 1) may be conveniently inserted prior to entering into the subsequent section, said drier being effective to remove residuals of the cooling fluid, such as humidity or water droplets, particularly in case such residuals turn out to be detrimental to the overall cable performance.

The insulated cable conductor 29 is then conveyed to the metal tape application section 30.

In a preferred embodiment, the application unit 30 includes a former by which the metal tape bearing on its externally facing surface an adhesive coating layer 7 is folded lengthwise into a tubular form so as to surround the insulated cable conductor, advancing there through, and to form the longitudinally folded metal tape. Formers of this type are well known by those skilled in the art.

Alternatively, the metal tape 7 may bear an adhesive coating layer both in its externally and in its internally facing surface. Conveniently, in the case in which the adhesive coating layer is present only on the externally facing surface of the metal tape, a suitable sealing and bonding agent may be supplied at the overlapping area of the edges of the metal tape by means of a glue applicator (not represented in FIG. 1). Said sealing and bonding agent is preferably selected from hot melt adhesives, more preferably from thermoplastic polymer adhesives such as, for example, polyamides, polyesters, polyethylene vinyl acetate, polyolefins, or mixtures thereof. Hot melt adhesive of this type are disclosed, for example, in U.S. Pat. No. 5,281,757.

Usually, the metal tape 7 bearing the adhesive coating layer is commercially available. Alternatively, the metal tape may be coated with the adhesive coating layer in-line during the cable production, or off-line in proximity of the cable production plant, by means of, for example, a calendering apparatus.

In the case in which a coating layer 6 made of an expanded polymeric material 6 is present, a further extruder 23*a* is located upstream from the application section 30 of the metal tape, together with a relevant cooler 26*a*, to apply the expanded polymeric material forming the coating layer, before the metal tape 7 is applied. Alternatively, the process of the present invention may include producing a cable insulated conductor with a coating layer 6 made of an expanded polymeric material as described before, and afterwards storing the so obtained cable conductor onto a collector reel; subsequently the stored insulated cable conductor so obtained is fed to the metal tape application section 30.

After the metal tape application unit 30, the insulated conductor covered with the longitudinally folded metal tape is conveyed to a further extruder apparatus 32, to apply a continuous coating layer and then to a cooler 26*b*.

The insulated conductor with the longitudinally folded metal tape and the extruded continuous coating layer 33, leaving the extruder apparatus 32 and the cooler 26*b*, is then finished by passing it through the external protective sheath extrusion section 34, which includes an oversheath extruder 35 and its cooler 26*c*, obtaining a finished cable.

Furthermore, in FIG. 5 is shown a system 27 for multiple passage of the cable in cooling channel 26*c*, this system consisting, for example, of a storage unit for the production line capable of guaranteeing an accumulation of cable on a scale sufficient to ensure a forward speed of the cable that is constant and equal to the preset value.

Finally, downstream from this cooling stage, the cable is preferably dried by means of air blowers (not represented in FIG. 5) and then wound onto a collector reel 28 and sent to a storage area.

In the case where the used coating material is of a crosslinkable type, a crosslinking operation may be provided after the relevant extrusion stages above reported. Said crosslinking operation may be carried out, for example, on a catenary line.

If a cable of multipolar type (e.g. as in the enclosed FIG. 1 and FIG. 3) is to be produced, the conductors (in the desired number) are covered with the relevant insulation layer or layers according to the process described before and the insulated conductors are separately wound on relevant reels. Then, the desired number of insulated conductors are stranded together and coated with a filler material 5 and subsequently supplied to the extruder 23*a* or to the metal tape application section 30 for the following process steps which will be carried out as disclosed above.

Although the present description mainly focuses on cables for the transmission and/or distribution of low-, medium- or high-voltage electric power, cables of different types such as, for example, control cables, signalling cables, instrumentation cables, copper data cables, cables for telecommunications, or even mixed power/telecommunication cables, may be made according to the present invention.

The present invention is further described in the following examples, which are merely for illustration and must not be regarded in any way as limiting the invention.

EXAMPLE 1

Cable Production

A medium-voltage cable of the tripolar type was prepared according to the construction scheme given in FIG. 3.

Each of the three cores possessed by said cable consisted of a copper conductor (of cross section equal to 150 $mm^2$) coated on the extrusion line with a 0.8 mm thick internal semiconductive coating layer, a 5.5 mm thick insulating coating layer, a 0.5 mm thick external semiconductive coating layer, the three coating layers being made of a crosslinked ethylene/propylene rubber based compounds. The extrusion was carried out by means of a triple extrusion line which comprises: a 80 mm, 25 D single-screw extruder for the internal semiconductive coating layer, a 150 mm, 25D single-screw extruder for the insulating coating layer and a 90 mm, 25D single-screw extruder for the external semiconductive coating layer. The temperatures in the various zone of the extruders were, respectively, the following: 50-100-110-120-120° C., extrusion head 115° C.; 80-90-95-100-100-100° C., extrusion head 115° C.; 50-100-110-120-120° C., extrusion head 115° C.

The above coating layers were peroxide-crosslinked on a catenary line. Subsequently, a tape of electrically conducting wires was spirally wound around each insulated conductor.

The so obtained insulated conductors and the three bare copper earth wires, were wound around one another and a layer of filling material made of the following composition: 10% by weight of ethylene-propylene elastomeric copolymer, 10% by weight of paraffinic oil, and 80% by weight of a magnesium carbonate:calcium carbonate mixture (50:50) (the percentage by weight is referred to the total weight of the composition), was extruded on said insulated conductors (each having an outside diameter of about 27.5 mm) an said bare copper earth wires. The thickness of said filling layer was equal to about 0.8 mm in the portion radially external to said cores, i.e. on the extrados regions of these cores. The extrusion of the filling layer was carried out by means of a 120 mm, 20D single-screw extruder. The temperature in the various zones of the extruder was the following: 60-80-100-100-100° C., the temperature of the extrusion head was 105° C.

In a successive step, a coating layer made of an expanded polymeric material was extruded on the filling layer thus obtained. More specifically, said coating layer was made of a propylene modified with ethylene/propylene copolymer (Hifax® SD 817—Basell). Said coating layer had a thickness equal to 2.5 mm, and the extrusion was carried out using a 120 mm, 25D single-screw extruder. The temperature in the various zones of the extruder was the following: 150-180-200-200-200° C., the temperature of the extrusion head was 200° C.

Expansion of the expanded coating layer was obtained chemically, by adding into a hopper 1.2% by weight (relative to the total weight) of the expanding agent Hydrocerol® BIH 40 (carboxylic acid/sodium bicarbonate), produced by Boehringer Ingelheim.

The cable leaving the extrusion head was cooled in water at 25° C. and subsequently dried, before entering the aluminum forming device.

The so obtained cable was then longitudinally folded with an aluminum tape of 0.3 mm in thickness, coated, both externally and internally, with an ethylene/acrylate copolymer film (Lucalen® A 3110 M from Basell) of 0.06 mm in thickness. The bonding of the overlapping edges was carried out by melting the copolymer by means of hot air.

In a successive step, a continuous layer made of a polyamide 6/linear low density polyethylene (LLDPE) blend (Orgalloy® LE 6000 from Atofina) of about 1.8 mm in thickness, was extruded on the aluminum tape. The extrusion was carried out by means of a 150 mm, 25D single-screw extruder. The temperature in the various zones of the extruder was the following: 210-250-260-270-270° C., the temperature of the extrusion head was 270° C. and the draw down ratio (DDR) was 1.7.

In a successive step, an outer protective sheath made of the composition reported in Table 1 (the amounts of the various components are expressed in parts by weight per 100 parts by weight of the polymeric base), was extruded on the continuous coating layer above disclosed. The thickness of said sheath was equal to about 3.2 mm. The extrusion was carried out by means of a 150 mm, 25D single-screw extruder. The temperature in the various zones of the extruder was the following: 150-160-165-165-165° C., the temperature of the extrusion head was 165° C.

The cable was then cooled in water and wound on a storage reel.

TABLE 1

| EXAMPLE | 1 |
|---|---|
| Engage ® 8003 | 80.00 |
| Moplen ® EP1X35HF | 10.00 |
| Orevac ® 18303 | 10.00 |
| Irganox ® 1010 | 0.50 |
| Rhodorsil ® MF175U | 1.50 |
| Hydrofy ® G-2.5 | 160.00 |
| Total | 262.00 |

Engage ® 8003: ethylene/1-octene copolymer obtained by metallocene catalysis: ethylene/1-octene weight ratio = 82/18 (5.5% by mole of 1-octene) ; (Dow-Du Pont);
Moplen ® EP1X35HF: propylene/ethylene random crystalline copolymer (Basell);
Orevac ® 18303: LLDPE grafted with maleic anhydride (MA): (Elf Atochem);
Irganox ® 1010: tetrakis[3-(3,5-di-t-butyl-4-hydroxy-phenyl)propionyloxymethyl]methane (antioxidant Ciba-Geigy);
Rhodorsil ® MF175U: processing coadjuvant/lubricant (silicone rubber - Rhone Poulenc);
HHydrofy G2.5: natural magnesium hydroxide surface treated with stearic acid (Nuova Sima).

All the ingredients were mixed in a closed Banbury mixer (volume of the mixing chamber: 1200 $cm^3$) with a volume filling of 95%. The mixing was carried out at a temperature of 180° C. for a total time of 10 min (rotor speed: 44 revolutions/min).

Oil and Fuel Resistance Test

An oil and fuel resistance test operating according to UL 1072 was made.

For this purpose, samples of cable with a length of 0.3 m, were immersed in:

FUEL C for 30 days at 23° C.;

IRM 902 oil for 60 days at 75° C.;

IRM 902 oil for 96 hours at 100° C.

Then the samples were removed from the fuel or from the oil, one of the three conductors with the insulating layer was recovered and die cut specimens were obtained according to Standard DIN 53504 S2 from the insulating layer. The obtained specimens were used for determining the elongation at break (E.B.) and the stress at break (S.B.) (according to Standard CEI EN 60811-1-1) with the Instron instrument at a traction speed of 50 mm/min. The obtained data were given in Table 2. In particular, Table 2 shows the elongation at break (E.B.) and the stress at break (S.B.) of the insulating coating layer and the % variation (% A) of said mechanical properties before (Starting Properties) and after ageing.

TABLE 2

| EXAMPLE | |
|---|---|
| STARTING PROPERTIES | |
| E.B. (%) | 380 |
| S.B. (MPa) | 17.6 |
| PROPERTIES AFTER AGEING FUEL C 30 days 23° C. | |
| E.B. (%) | 375 |
| S.B. (MPa) | 17.4 |
| % Δ E.B. | −1% |
| % Δ S.B. | −1% |
| IRM 902 oil 60 days 75° C. | |
| E.B. (%) | 360 |
| S.B. (MPa) | 17.8 |
| % Δ E.B. | −5% |
| % Δ S.B. | 1% |
| IRM 902 oil 96 hours 100° C. | |
| E.B. (%) | 330 |
| S.B. (MPa) | 16.0 |
| % Δ E.B. | −13% |
| % Δ S.B. | −9% |

The above reported data show that the % variation (% Δ) of both the elongation at break (E.B.) and the stress at break (S.B.) after ageing is very low.

EXAMPLE 2

A cable was produced as disclosed in Example 1, the only difference being the fact that the continuous layer made of a polyamide 6/linear low density polyethylene (LLDPE) blend (Orgalloy® LE 6000 from Atofina) was extruded at a draw down ratio (DDR) of 4.0.

Adhesion (Peeling) Test

Test pieces of the metal tape with the adhesive layer and the continuous coating layer with the following dimensions 10 mm width×100 mm length were obtained from the cable. Test pieces having the same dimensions were also obtained from the cable of Example 1.

Said pieces, were subjected to the peel test according to Standard EDF NF C 33-223 using an Instron 4202 dynamometer, the clamps of which were applied to the metal tape at one end and to the continuous coating layer at the other end (the two end were manually peeled off before applying the clamps). A traction speed equal to 50 mm/min was then applied and the peel force (PF) values thus measured, expressed in Newtons (N), are given below and are each the average value calculated for 4 test pieces:

cable of Example 2: 10 N;

cable of Example 1: 25 N.

Figure 6:
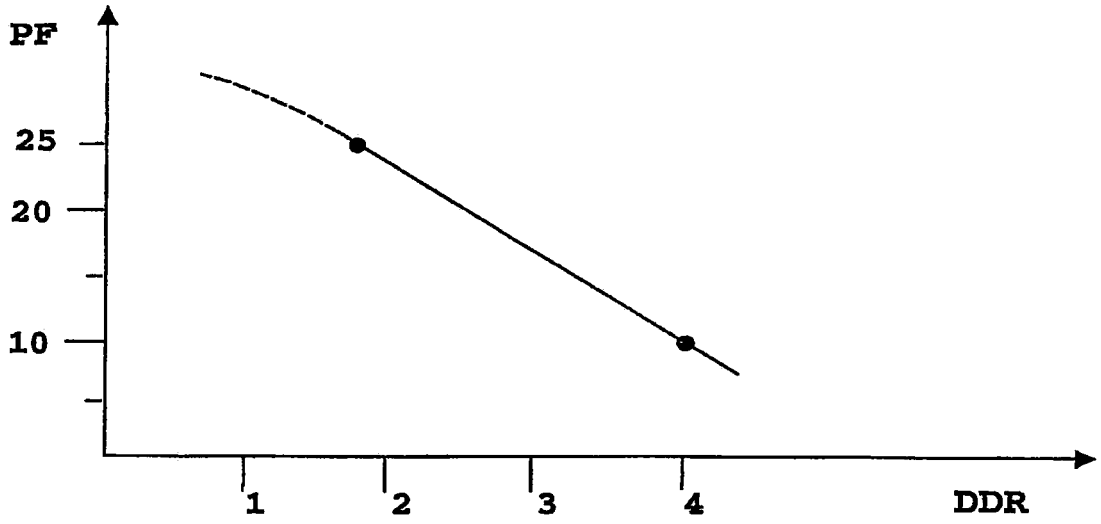
FIG. 6 shows the relationship between the draw down ratio (DDR) and the peeling force (PF).

The relationship between the draw down ratio (DDR), the peel force (PF), and the test results are represented in FIG. 6. As shown by the figure, the draw down ratio (DDR) turns out to be critical to the adhesion of the continuous coating layer to the metal tape and it has been found that only maintaining the draw down ratio (DDR) value below critical value, a satisfactory peel force (PF) value (e.g. not lower than 20N) can be obtained.

The invention claimed is:

1. A cable comprising:

at least one conductor;

at least one insulating coating layer around said at least one conductor;

at least one metal tape longitudinally folded around said at least one insulating coating layer, said metal tape bearing on its externally facing surface at least one ethylene based adhesive coating layer, wherein the longitudinally folded metal tape has a thickness of 0.05 mm to 1.0 mm and overlapping edges;

at least one continuous coating layer comprising at least one polyamide or a copolymer thereof in a radially external position with respect to said at least one adhesive coating layer, said continuous coating layer being in contact with said at least one adhesive coating layer;

at least one further adhesive coating layer in a radially inner position with respect to said at least one metal tape, said at least one further adhesive coating layer being in contact with said at least one metal tape; and at least one coating layer made of expanded polymeric material in a radially inner position with respect to said at least one metal tape.

2. The cable according to claim 1, wherein the insulating coating layer comprises at least one crosslinked ethylene/propylene or ethylene/propylene/diene elastomeric copolymer.

3. The cable according to claim 1, wherein the metal tape is made of aluminum, aluminum alloys, alloy-clad aluminum, copper, bronze, steel, tin free steel, tin plate steel, aluminized steel, stainless steel, copper-clad stainless steel, terneplate steel, galvanized steel, chrome or chrome-treated steel, lead, magnesium, tin, or mixtures thereof.

4. The cable according to claim 1, wherein the adhesive coating layer comprises at least one copolymer derived from ethylene and at least one comonomer selected from ethylenically unsaturated carboxylic acids.

5. The cable according to claim 1, wherein the adhesive coating layer has a thickness of 0.01 mm to 0.1 mm.

6. The cable according to claim 1, wherein the continuous coating layer comprising at least one polyamide or a copolymer thereof is selected from the condensation products of at least one amino acid, aminocaproic acid, 7-aminoheptanoic acid, 11-aminoundecanoic acid, 12-aminododecanoic acid, or of at least one lactam, caprolactam, oenantholactam, lauryllactam, or of at least one salt or mixtures of diamines, hexamethylenediamine, dodecamethylene diamine, metaxylylenediamine, bis(p-aminocyclohexyl)methane, trimethylhexamethylene, with at least one diacid, isophthalic acid, terephthalic acid, azelaic acid, suberic acid, sebacic acid, dodecanedicarboxylic acid; or mixtures of all these monomers.

7. The cable according to claim 1, wherein the continuous coating layer has a thickness of from 0.5 mm to 3 mm.

8. The cable according to claim 1, wherein the coating layer made of an expanded polymeric material comprises at least one expandable polymer selected from: polyolefins, copolymers of different olefins, copolymers of an olefin with an ethylenically unsaturated ester, polyesters, polycarbonates, polysulphones, phenol resins, urea resins, or mixtures thereof.

9. The cable according to claim 1, further comprising:

a semiconductive coating layer radially internal to said insulating coating layer; and a semiconductive coating layer radially external to said insulating coating layer.

10. The cable according to claim 9, wherein a screen consisting of spirally wound electrically conducting wires or tapes is arranged around the semiconductive coating layer radially external to said insulating coating layer.

11. The cable according to claim 1, comprising, in addition to the coating layers defined above, at least one coating layer with the function of external protective sheath.

12. A cable comprising;

at least one conductor;

at least one insulating coating layer around said at least one conductor;

at least one metal tape longitudinally folded around said at least one insulating coating layer, said metal tape bearing on its externally facing surface at least one ethylene based adhesive coating layer, wherein the longitudinally folded metal tape has a thickness of 0.05 mm to 1.0 mm and overlapping edges;

at least one continuous coating layer comprising at least one polyamide or a copolymer thereof in a radially external position with respect to said at least one adhesive coating layer, said continuous coating layer being in contact with said at least one adhesive coating layer;

a semiconductive coating layer radially internal to said insulating coating layer; and a semiconductive coating layer radially external to said insulating coating layer;

wherein a screen consisting of spirally wound electrically conducting wires or tapes is arranged around the semiconductive coating layer radially external to said insulating coating layer.

13. The cable according to claim 12, wherein the insulating coating layer comprises at least one crosslinked ethylene/propylene or ethylene/propylene/diene elastomeric copolymer.

14. The cable according to claim 12, wherein the metal tape is made of aluminum, aluminum alloys, alloy-clad aluminum, copper, bronze, steel, tin free steel, tin plate steel, aluminized steel, stainless steel, copper-clad stainless steel, terneplate steel, galvanized steel, chrome or chrome-treated steel, lead, magnesium, tin, or mixtures thereof.

15. The cable according to claim 12, wherein the adhesive coating layer comprises at least one copolymer derived from ethylene and at least one comonomer selected from ethylenically unsaturated carboxylic acids.

16. The cable according to claim 12, wherein the adhesive coating layer has a thickness of 0.01 mm to 0.1 mm.

17. The cable according to claim 12, wherein the continuous coating layer comprising at least one polyamide or a copolymer thereof is selected from the condensation products of at least one amino acid, aminocaproic acid, 7-aminoheptanoic acid, 11-aminoundecanoic acid, 12-aminododecanoic acid, or of at least one lactam, caprolactam, oenantholactam, lauryllactam, or of at least one salt or mixtures of diamines, hexamethylenediamine, dodecamethylene diamine, metaxylylenediamine, bis(p-aminocyclohexyl)methane, trimethylhexamethylene, with at least one diacid, isophthalic acid, terephthalic acid, azelaic acid, suberic acid, sebacic acid, dodecanedicarboxylic acid; or mixtures of all these monomers.

18. The cable according to claim 12, wherein the continuous coating layer has a thickness of from 0.5 mm to 3 mm.

19. The cable according to claim 12, comprising at least one further adhesive coating layer in a radially inner position with respect to said at least one metal tape, said at least one further adhesive coating layer being in contact with said at least one metal tape.

20. The cable according to claim 12, further comprising, in a radially inner position with respect to said at least one metal tape, at least one coating layer made of expanded polymeric material.

21. The cable according to claim 20, wherein the coating layer made of an expanded polymeric material comprises at least one expandable polymer selected from: polyolefins, copolymers of different olefins, copolymers of an olefin with an ethylenically unsaturated ester, polyesters, polycarbonates, polysulphones, phenol resins, urea resins, or mixtures thereof.

22. The cable according to claim 12, comprising, in addition to the coating layers defined above, at least one coating layer with the function of external protective sheath.

* * * * *